United States Patent [19]

Robichaud

[11] 4,350,139

[45] Sep. 21, 1982

[54] SOLID FUEL HEATER WITH IMPROVED PRIMARY/SECONDARY AIR CONTROL SYSTEM

[76] Inventor: John F. Robichaud, 35 Mountain Ave., White River Junction, Vt. 05001

[21] Appl. No.: 111,500

[22] Filed: Jan. 11, 1980

[51] Int. Cl.[3] ..... F24C 1/14

[52] U.S. Cl. ..... 126/77; 126/4; 126/58; 126/126; 126/163 R

[58] Field of Search ..... 126/77, 83, 163 R, 152, 126/164, 58, 121, 73, 120, 71, 72, 146, 70, 4, 126, 6, 15 R, 15 A

[56] References Cited

U.S. PATENT DOCUMENTS

| | | | |
|---|---|---|---|
| 239,177 | 3/1881 | MacDonald | 126/58 |
| 698,797 | 4/1902 | Cahoone | 126/77 |
| 852,209 | 4/1907 | Watson, Sr. | 126/77 |
| 925,570 | 6/1909 | Eckert | 126/15 R |
| 1,866,427 | 7/1932 | Siemer | 126/58 |
| 2,345,519 | 3/1944 | Wingert | 126/77 |
| 2,564,713 | 8/1951 | Miles | 126/73 |
| 3,955,553 | 5/1976 | Soeffker | 126/163 R |
| 4,020,824 | 5/1977 | Dodson | 126/164 |
| 4,180,051 | 12/1979 | Maier et al. | 126/77 |
| 4,194,487 | 3/1980 | Cadwallander et al. | 126/77 |
| 4,232,653 | 11/1980 | Otterpohl | 126/15 A |

*Primary Examiner*—Larry Jones

*Attorney, Agent, or Firm*—Sughrue, Mion, Zinn, Macpeak & Seas

[57] ABSTRACT

A solid fuel heater comprises a plurality of horizontal tubes defining between a vertical partition and an opposed vertical wall of the heater, a tubular grate with given ones of the tubes connected to a primary air source manifold header while others are connected to a secondary air source manifold header for preheating the air. The ends of the tubes opposite the connection to the headers open, respectively, to the upper side of the tubular grate for delivery of primary air and to the lower side for delivery of secondary air. The vertical partition wall forms a hot air passage for a downdraft operation leading to the stack. Preferably, a secondary grate underlies the tubular grate. By operating in a downdraft manner, only the lower ends of the solid fuel are burned, permitting low stack temperatures and long burning operation of the heater whether wood or coal fired.

8 Claims, 6 Drawing Figures

FIG. 1
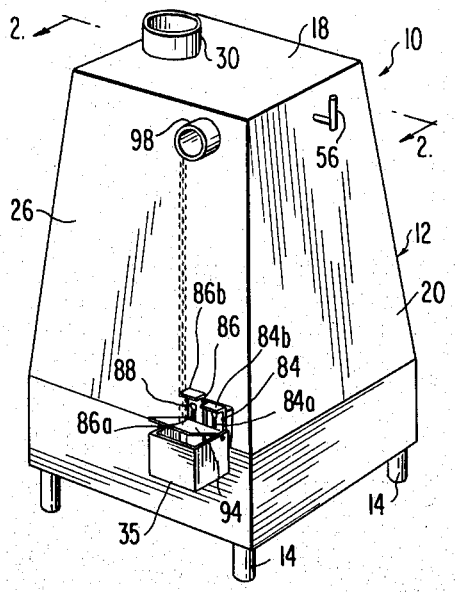
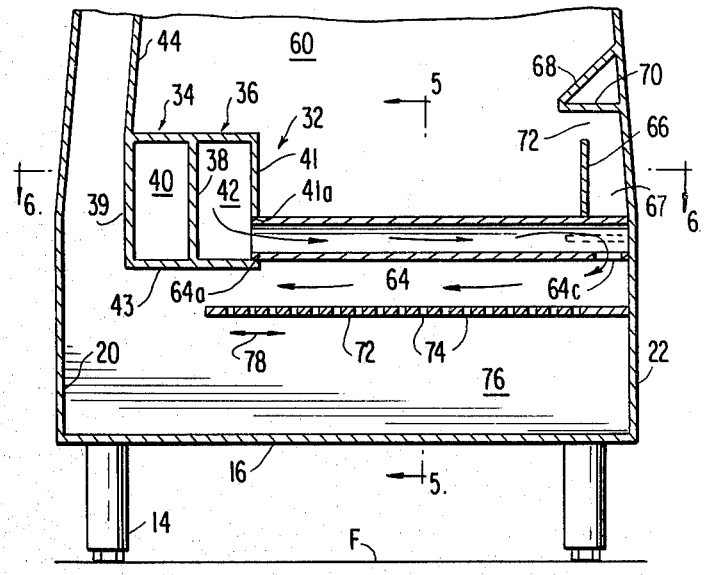
FIG. 4
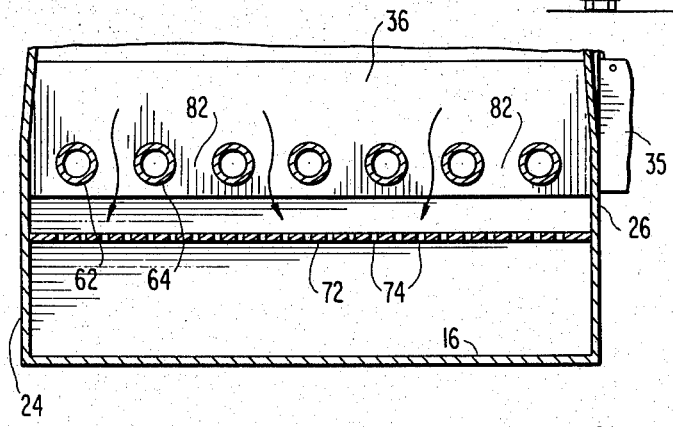
FIG. 5
FIG. 6
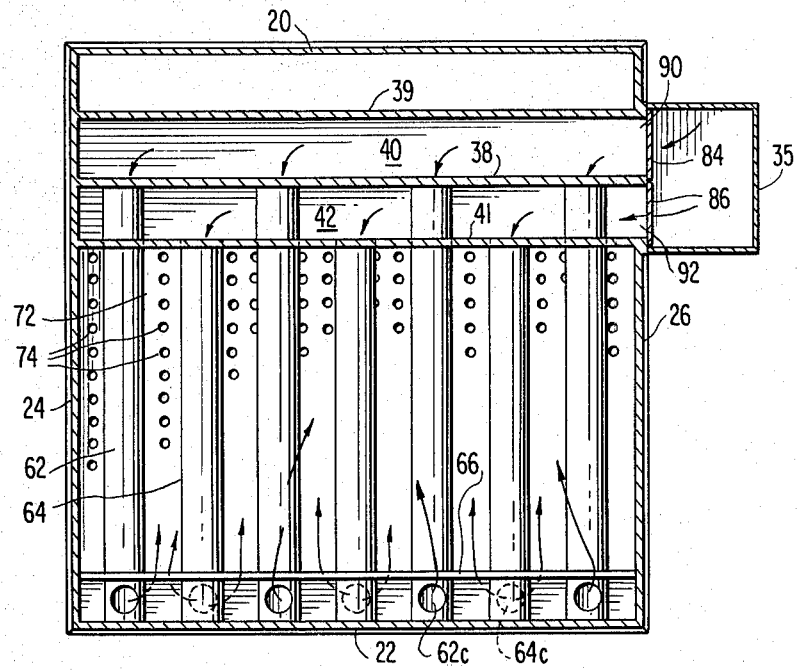

SOLID FUEL HEATER WITH IMPROVED PRIMARY/SECONDARY AIR CONTROL SYSTEM

FIELD OF THE INVENTION

This invention relates to solid fuel heaters such as wood or coal burning stoves or furnaces, and more particularly, to such heaters which employ an arrangement for supplying both primary and secondary air to the combustion chamber.

BACKGROUND OF THE INVENTION

Due to the relatively high cost of liquid hydrocarbon fuels and fuel gas, wood burning and coal burning stoves have recently come back into vogue and are employed in a great many homes for providing the basic heat to those homes. With the advent of the modern type wood burning or coal burning stoves which are essentially air tight except for the controlled entry of primary and/or secondary air to the combustion area, the time for burning a full load of wood fuel has been extended and lasts well through the night. Such combustion provided by these stoves is highly efficient, and the cost of heating residential homes has been reduced considerably from that experienced in heating by conventional oil fired and gas fired furnaces.

Attempts have been made to provide such solid fuel burning stoves and furnaces, an arrangement for feeding both primary and secondary air, the primary air being directed to the area of primary combustion, while secondary air flow is directed to the area where the ashes reside for insuring complete combustion of those resulting products of combustion as well as the complete combustion of combustible elements carried by air streams circulating within the stove or furnace.

In order to maximize the efficiency in the burning of solid fuels such as wood or coal, attempts have been made to produce a downdraft type of action in which the hot gases are directed downwardly from the area of primary combustion and by way of baffles, prevented from passing vertically upwardly through the unburned portion of the fuel prior to escaping through the stack. This permits more efficient thermal radiation to the room interior from the various walls of the burner as well as tending to limit the burning rate. Absent some type of control scheme, there is a great fluctuation in the BTU output of the burner. During intitial and early combustion, only a portion of the wood or coal is burning, and the heat is rather limited, while as the solid fuel burns upwardly, at some point in time, the major portion of the fuel stacked vertically within the heater is under combustion with an excessive amount of heat being radiated to the room or building structure housing the burner. Further, as the load of fuel is consumed, there is a time when only a small amount of that fuel remains unburned, and at that point the temperature drops, and the heat produced is insufficient to maintain proper temperature relative to the load provided by the building. Further, conventional solid fuel heaters, such as stoves or furnaces, tend to discharge a large amount of the heat up the stack where it is wasted to the building exterior through the stack, chimney, etc.

It is a primary object of the present invention, therefore, to produce an improved solid fuel heater in the form of a wood burning stove or furnace in which the burning of the fuel and the BTU output is controlled by separate adjustment of primary and secondary air through a thermostatically controlled damper, and wherein the heater is of the down draft type to promote combustion only of the bottom of the solid fuel stack within the burner.

It is a further object of the present invention to provide a downdraft, primary/secondary air type heater which insures the complete combustion of the solid fuel greatly reducing the mass of the ashes which must be periodically removed from the bottom of the burner.

It is a further object of the present invention to provide an improved solid fuel heater which employs a plurality of tubes for preheating the primary and secondary air flow prior to discharge of that air into the primary and secondary combustion areas of the heater.

SUMMARY OF THE INVENTION

The fuel stove or furnace of the present invention comprises a generally hollow vertical metal enclosure having top, bottom, front, rear and opposed sidewalls, which principally define a vertical combustion chamber. A stack extends vertically upwardly from the top of the enclosure and opens to the combustion chamber via a vertical partition means extending partially along one vertical wall and spaced from said one vertical wall to define a vertical hot air flow passage to one side of the combustion chamber. Interposed first and second spaced, horizontal primary grate tubes extending respectively across the bottom of the combustion chamber from the vertical partition to the other enclosure wall opposite said one wall forming, with the partition, the vertical hot air flow passage. Primary and secondary air manifold headers are operatively coupled to one end of respective first and second horizontal tubes. The first tubes terminate at their ends opposite the primary manifold header in openings which open upwardly towards the top of the metal enclosure, and the second tubes open at their ends opposite the secondary manifold header downwardly towards the bottom of the metal enclosure. Access means are provided within the metal enclosure for supplying solid fuel to the combustion chamber and onto the first and second primary grate tubes. The primary and secondary air manifold headers open to the exterior of the metal enclosure such that primary air enters the primary manifold header and flows through the first group of horizontal primary grate tubes for preheating of the primary air and through the tube openings to enter the combustion chamber at the lower portion thereof to effect primary combustion of the lower ends of the solid fuel, and this primary air passes downwardly between the first and second groups of horizontal tubes to the hot air flow passage and thence to the stack. Secondary air flows horizontally through the second group of spaced horizontal primary grate tubes where it is preheated prior to discharge through the holes within the bottoms of the second horizontal primary grate tubes for mixing with the primary air flow effecting the combustion of gases given off by the primary combustion of the solid fuel, establishing secondary combustion and at the same time effecting combustion of the unburned solid fuel dropping beneath the primary grate and for movement commonly through the hot air flow passage with the primary air prior to discharge through the stack. The solid fuel heater may further comprise a secondary grate extending horizontally beneath the primary grate horizontal tubes for maintaining hot coals in a horizontal air path of the combined primary and secondary air flows to maximize combustion of the solid fuel not previously consumed in the primary combustion chamber above the spaced horizontal primary grate tubes.

A vertical divider wall extends upwardly from the horizontal primary grate tubes at their ends opposite the manifold headers and internally of the openings within the first tubes for directing primary air upwardly between the divider wall and said adjacent other vertical wall of the metal enclosure prior to spilling over into the combustion chamber. Filler plates extend between the spaced horizontal primary grate tubes so as to prevent primary air from passing downwardly between the horizontal primary grate tubes into the area between the primary grate tubes and the secondary grate.

An inclined shield extends inwardly from said other vertical wall of the metal enclosure and overlies the divider wall but is spaced vertically therefrom so as to prevent solid fuel from entering the primary air flow passage between the vertical divider wall and said other vertical wall of the metal enclosure and from blocking the holes within the tops of said first horizontal primary grate tubes, thereby assuring the passage of primary air to the main combustion area above the primary grate tubes.

A false top wall underlies the top wall and extends from the vertical partition to said other vertical wall. A hole is provided within the false top wall and generally aligned with the hole within said top wall and an updraft damper plate is slidably mounted to the false top wall so as to selectively overlie the hole and to permit by movement of the updraft damper plate to change or vary the down flow characteristics of the heater and permit, selectively, updraft flow through the false top wall hole directly to the stack, bypassing the hot air flow passage.

Preferably, the primary and secondary manifold headers comprise elongated chambers sealed from the combustion chamber and extending across the heater from one side to the other, and wherein one group of tubes opens directly into and are fixed to one vertical wall of the manifold header and the other set of tubes extend through that header and are connected to open directly through a vertical wall separating the first and second manifold headers to the interior of the second manifold header. The ends of the headers extend outwardly of the enclosure and define primary and secondary air intake openings exterior of the enclosure. The manifold headers bear separable adjustable primary and secondary draft gates adjustably closing off the air intake openings to the primary and secondary air manifold headers.

A primary and secondary air intake box comprises a rectangular enclosure open at its top and a cover is hinged to a vertical wall of the enclosure and pivots to cover the open top of the primary and secondary air intake box. A thermostat may be mounted to the heater enclosure to sense the temperature of a portion of the solid fuel heater and is operatively coupled to the hinged cover such that the rate of flow of primary and secondary air is varied in accordance with the temperature of that portion of the solid fuel heater so as to tend to maintain uniform the temperature within the environment housing the heater.

BRIEF DESCRIPTION OF THE DRAWINGS

FIG. 1 is a perspective view of a solid fuel heater in the form of a stove forming one embodiment of the present invention.

FIG. 4 is a vertical sectional view of a portion of the stove of FIG. 1 showing the nature of the secondary air flow passages.

FIG. 5 is a vertical sectional view of the portion of the stove shown in FIG. 4 taken about line 5—5.

FIG. 6 is a horizontal sectional view of the portion of the stove shown in FIG. 4 taken about line 6—6.

DESCRIPTION OF THE PREFERRED EMBODIMENT

Figure 3:
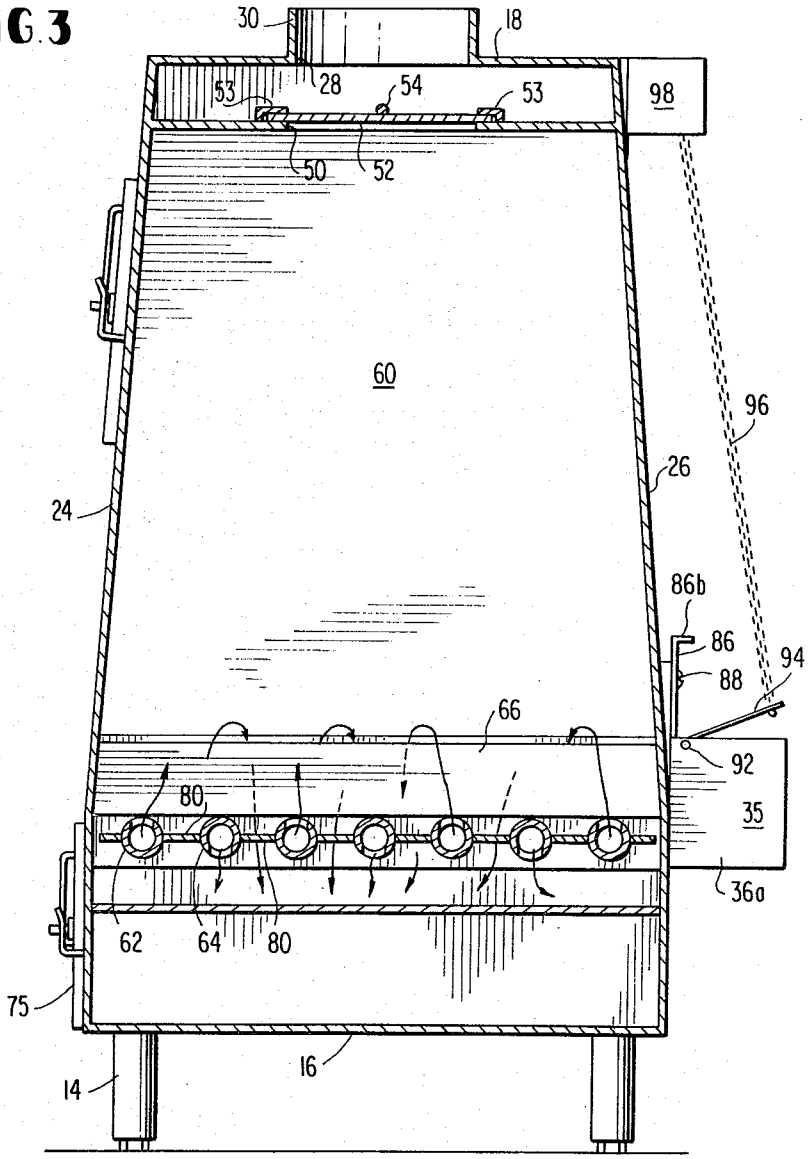
FIG. 3 is a vertical sectional view of the stove taken about line 3—3 of FIG. 2.

Turning to the drawings, the illustrated embodiment of the solid fuel heater of this invention takes the form of a wood or coal solid fuel stove for a residence building or the like, which stove is self standing and which connects by way of a stack to a chimney (not shown) within that building. Alternatively, of course, the solid fuel burner of the present invention could constitute a furnace, either forced air or otherwise. The invention has application to a flash steam generator, a hot water or hot air furnace in addition to a simple wood burning stove, as in the illustrated embodiment.

The solid fuel stove, indicated generally at 10, comprises a metal enclosure indicated generally at 12 which is floor mounted on floor F by means of a series of legs 14 whose height may be readily adjusted to insure leveling of the enclosure 12. The components of the above are formed of metal and the enclosure is preferably formed of metal including a bottom wall 16, a top wall 18, a front wall 20, a rear wall 22, and laterally opposed sidewalls 24 and 26. The top wall 18 is provided with a circular hole 28 within the same from which arises a vertical stack 30. The stack 30 connects by way of a pipe (not shown) to a chimney (not shown) for the building (not shown) housing the stove or furnace and employing the same for room heating purposes.

The sheet metal walls of the enclosure 12 may be welded together to form an essentially sealed enclosure except for stack 30, and access doors for feeding fuel and removing ashes, and primary and secondary air inlets provided to the walls of the enclosure.

While in the illustrated embodiment the stove 10 has two vertical walls which taper slightly so that the top of the stove is narrower than the bottom, the purpose of this is to insure that solid fuel in the form of firewood, when introduced to the enclosure interior, does not hang up during the combustion process but continually feeds itself under gravity toward the grate supporting this fuel for combustion, and the front, rear and side walls may be straight.

The principal aspect of the present invention resides in the manifold grate assembly as indicated generally at 32. The manifold grate assembly 32 comprises primary and secondary air intake manifold housings or headers as at 34 and 36, respectively, which are rectangular elongated boxes in form and extend completely across the interior of the enclosure 12 from one sidewall 26 to the other sidewall 24. The primary and secondary air manifold headers which are integral open at one end commonly to a primary and secondary air inlet box which mounts exteriorly of the enclosure 12 and being indicated generally at 35, FIG. 1. A common vertical wall 38 separates the primary and secondary air intake manifold headers to define primary and secondary air intake passages 40 and 42 which passages are parallel to each other, but completely separated by way of the vertical partition wall 38. In the illustrated embodiment of the present invention, the primary air intake manifold header 34 is connected to the bottom edge of wall 44 of the enclosure, wall 44 extending generally vertically upwardly from the primary intake air manifold header 34. The partition wall 44 defines with the front wall 20 a vertical hot air passage 46 leading to the top of the enclosure 12. Extending transversely across the enclosure but spaced vertically downwardly from top wall 18 is a false top wall 48. Wall 48 extends from the upper edge of partition wall 44 to rear wall 22 to close off the hot air passage 46 to the interior of enclosure 12 and forces the hot air passing through passage 46 to exit directly to the stack 30 for discharge to the atmosphere. The false top wall 48 includes an opening or hole 50, which hole 50 is covered by a transversely slidable updraft damper plate 52, which plate 52 rests on the false top wall 48 and is guided by inverted L-shaped guides 53. An operating rod 54 is welded at one end to the damper plate 52 and its opposite end bears a handle 56 such that by pulling on handle 56, the damper plate 52 may be moved in the direction of arrow 58 to directly communicate solid fuel primary combustion chamber 60 which underlies the false top wall 48 with the stack 30 and thus the chimney flue to which it is attached. However, it should be noted that the updraft damper plate 52 completely closes off the hole or opening 50 during normal operation and the stove operates as a downdraft burner.

Figure 2:
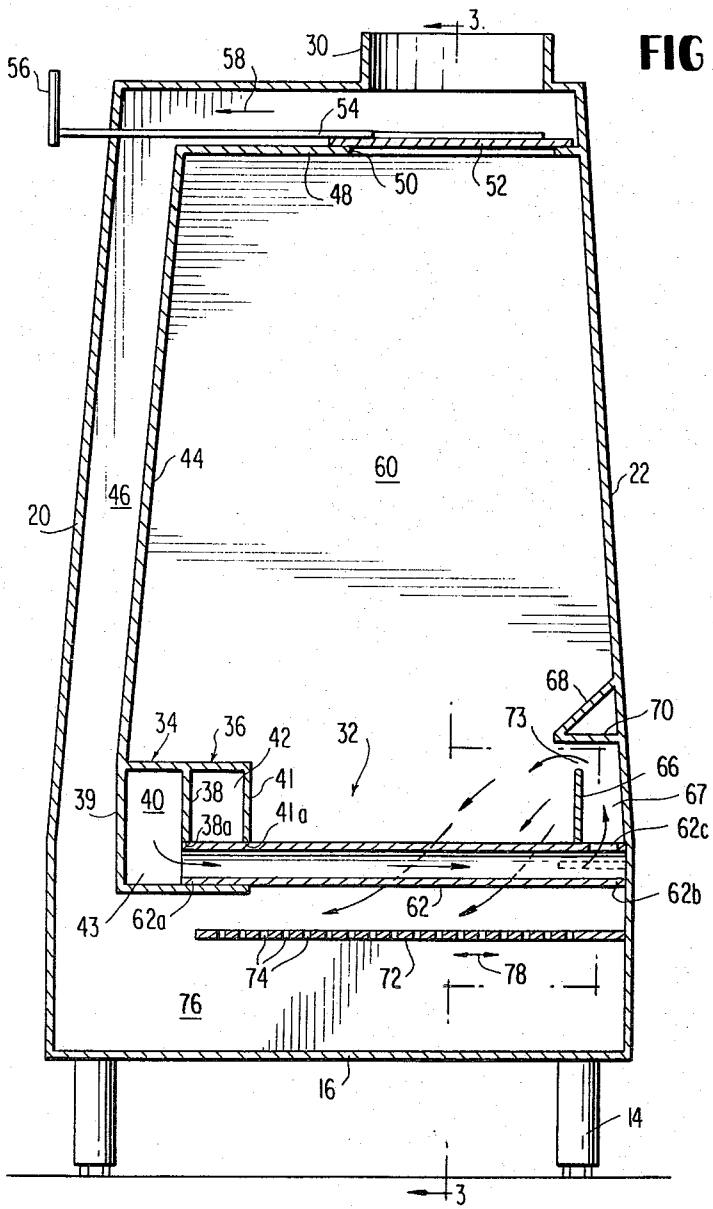
FIG. 2 is a vertical sectional view of the stove of FIG. 1 taken about line 2—2.

As a further important aspect of the present invention, the primary air passage 40 and the secondary air passage 42 are connected, respectively, to a plurality of interposed first, primary air draft tubes 62 and, second, secondary air draft tubes 64. Tubes 62 and 64 lie communly in a horizontal array defining a primary rate. The air within the primary air passage 40 passes through holes **38*a* within the vertical partition wall 38 joining the manifold header within which are fixedly and sealably mounted one end 62*a* of the primary grate tubes 62, FIG. 2, their opposite ends 62*b* being mounted directly to the rear wall 22** of the enclosure.

Further, vertical wall 41 of the manifold header 36 includes openings **41*a* through which the primary air grate tubes 62 extend. Thus, the primary air grate tubes 62 extend completely through the secondary air passage 42. Within each of the primary air tubes 62, there is provided a primary air outlet hole 62*c* which opens to the top of those tubes to direct primary air into the solid fuel primary combustion chamber 60. In order to effect the desired flow of such primary air for combustion of only the lowermost solid fuel to a predetermined height, there is positioned within the solid fuel primary combustion chamber 60, a vertical divider wall 66 which extends the full lateral width of the enclosure, FIG. 3, from one sidewall 24 to the other sidewall 26. This forces the primary air to rise between that divider wall 66 and the rear wall 22 within primary air flow passage 67 prior to entering into the solid fuel primary combustion chamber at some vertical height with respect to the tops of the various tubes 62, 64, forming the horizontal tube array for the manifold grate assembly 32**.

Integral with the rear wall 22, in the illustrated embodiment, is an inclined transversely extending plate or shield 68 which overlies the primary air flow passage 67 defined by the rear wall 22 and divider wall 66. The shield 68 prevents debris, wood or other solid fuel from entering into the primary air passage 67 and blocking the same or the plurality of primary air outlet holes **62*c* within tubes 62. The shield 68 and its underlying horizontal support plate 70 are spaced vertically above the upper end of the divider wall 66 so as to form a gap 73 through which air can spill into the lower end of solid fuel primary combustion chamber 60. As may be appreciated, by varying the height of the divider 66 and the position of the shield 68, the coal bed may be raised or lowered to vary the portion of the solid fuel under direct combustion and therefore the rate of BTUs supplied by the heater to the space being conditioned as well as the burning rate for the solid fuel normally filling the solid fuel combustion chamber 60. If desired, shield 68 may be mounted to the rear wall 22** for vertical adjustment.

As may be seen in FIG. 4, the secondary air draft tubes 64 have ends **64*a* which are fitted within openings 41*a* of the vertical wall 41 partially defining the secondary air passage 42. The hollow secondary air draft tubes 64, instead of having holes at the ends opposite the ends joined to the manifold header 36 which open towards the solid fuel primary combustion chamber 60, open at their bottoms as at 64*c* towards an underlying horizontal plate 72 forming a secondary grate. Secondary grate 72 bears perforations 74, and supports any burned or burning particles of the solid fuel falling from the upper solid fuel primary combustion chamber 60, between the laterally spaced primary grate tubes 62 and 64. The secondary grate 72 extends the full length of the longer primary grate tubes 62, and underlies the common bottom wall 43 of the primary and secondary air manifold headers 34, 36. This secondary grate 72 defines with the bottom wall 16, an ash pit 76. Means as at 76 within the enclosure wall 22 provides access to the ash pit 76 for removal of ashes accumulating within the bottom of the enclosure 12**.

Further and preferably, the secondary grate 72 is mounted for transverse oscillation as indicated by arrow 78 to permit in a conventional manner, the forced removal of ashes from the upper surface of the secondary grate 72 to the ash pit 76. Alternatively, a scraper (not shown) could be mounted for movement across the top of the secondary grate 72 to force the ashes to fall into the lower ash pit 76 of the stove.

As may be appreciated in FIG. 3, between all of the tubes 62 and 64 adjacent the rear wall 22 of the enclosure, there are provided filler plates as at 80 which join the tubes and spearate the primary and secondary air flow as it escapes through holes **62*c* of the primary air draft tubes 62 and holes 64*c* for the secondary air draft tubes 64. Thus, primary air, after preheating, must first initially move upwardly through the primary air passage 67 and pass over the lower end of the solid fuel filling the combustion chamber 60 prior to passing through openings 82 between the laterally spaced primary and secondary draft tubes 62 and 64 and between the divider wall 66 and vertical wall 41 of the manifold header 36. The presence of the filler plates 80 also insures that the secondary air, which is heated by flow from its manifold passage 72 through the secondary air draft tubes 64 to the bottom holes 64*c* within the bottom of these tubes 64, enters that portion of the enclosure underlying the draft tubes 62, 64 and above the secondary grate 72. The heated secondary air mixes with the primary air after the primary air has moved downward through openings 82 because of the downdraft action due to closure of the updraft damper plate 52, to the hot air passage 46 adjacent the front wall 20 of the enclosure and upwardly between that wall and the generally vertical partition 44. The combustion action and thus the extent of burning of the solid fuel, and the BTUs produced, depends to a large degree upon the mass flow rate of primary and secondary air entering the enclosure 12 from the exterior and exiting through the stack 30. As may be appreciated from FIGS. 4 and 6, at the point where the manifold headers 34, 36 open via openings 90 and 92, respectively, to the exterior of the enclosure wall 26, there is provided a primary air draft gate at 84 and a secondary air draft gate at 86. The gates 84 and 86 take the form of inverted L-shaped metal strips or plates which bear slots as at 84***a* and 86*a*, respectively. The slots receive screws 88. The gates bear integrally at 84*b* and 86*b*, respectively, flanges or lips, permitting ready grasping to allow raising and lowering of these gates by sliding the gates along their integral slots 84*a* and 86*a*, respectively. The screws 88 frictionally lock the gates in vertically adjusted positions, thereby adjusting the size of air inlet passages formed by the openings 90 and 92 leading from the air inlet box 35 to the manifold passages 40 and 42, respectively. The proportion of primary air to secondary air may be directly controlled by the height of the secondary air draft gate in relation to the height of the primary air draft gate. The gates are held in given raised position by means of the adjustment screws 88.

Further, the mass flow rate of air is determined by the extent of opening and closure of a hinged cover 94 which overlies the open top of the air inlet box 35. Box 35 includes opposed sidewalls 35*a* bearing hinge pins 93 which hinge mount the cover 94. The cover 94 is shown in FIG. 3 in an inclined or raised position, being held in such position by means of a chain 96, one end of which is fastened to the hinged cover 94 and the opposite end is operatively connected to thermostat 98. The thermostat 98 includes motor means for raising and lowering the chain and thus variably closing off the top of the air inlet draft box 36 to a greater or lesser extent. While the thermostat 98 is shown as being fixed to the side 26 of the enclosure, so as to sense the temperature of the enclosure 26 near its connection to stack 30, it may be in fact connected to the stack or to the flue pipe rising therefrom.

Further, while screw locked L-shaped primary and secondary draft gates are shown in the illustrated embodiment, they may be replaced by spring biased swinging or hinged doors within the air inlet draft box 35, overlying openings 90 and 92, with their springs normally tending to bias those doors towards closed position and having a screw means or other mechanisms for forcing the doors to open to a desired extent against the bias and permit entry of inlet air to the primary and secondary manifold passages 40 and 42, respectively.

The present invention permits the solid fuel combustion chamber 60 to be as tall as desired because the fuel drops to a fire area principally defined by the height of the divider wall 66 as needed. The flame does not go up through the fuel as during normal combustion, the updraft damper plate 52 completely closes off opening 50 within the false top 48. Thus, this provides a constant thermal BTU output. The constant BTU output eliminates the normal cool and hot cycles during cyclic fuel feeding to the stove. It also allows for longer unattended burning periods and permits forced draft if necessary. The heater can be used for hot air, hot water or steam heat, and the steam could be effected by water jacket or flash coils.

A byproduct of primary combustion of solid fuel is unburned gases and different solid fuels such as wood and coal give off different amounts of unburned gases. Where different amounts of unburned gases require different amounts of preheated secondary air for efficient secondary combustion, separate control of primary air and secondary air is advantageous.

The present invention allows for the separate adjustment of primary air and secondary air by 84 and 86 for overall efficient combustion, in conjunction with overall BTU control by damper 94.

Further, while the stove is not shown as having a combustion chamber lined with fire brick or employing closely spaced double walls, such may be achieved readily without modification to the basic design. The primary grate tubes heat both the primary and secondary air as hot as possible by passing it through the red hot coals to produce maximum efficient combustion. The advantageous employment of the secondary grate insures complete burning of all combustible portions of the fuel and all of the coals prior to falling into the ash pit 76.

While the invention has been particularly shown and described with reference to a preferred embodiment thereof, it will be understood by those skilled in the art that various changes in form and details may be made therein without departing from the spirit and scope of the invention.

What is claimed is:

1. A solid fuel heater comprising:

a generally hollow vertical metal enclosure having top, bottom and generally vertical front, rear and opposed sidewalls defining a vertical primary combustion chamber, a stack extending vertically upwardly from the top of said enclosure and opening to said combustion chamber, a generally vertical partition means extending partially along one generally vertical wall and spaced therefrom to define a generally vertical hot air flow passage to one side of said combustion chamber, a plurality of interposed coplanar, first and second spaced horizontal air draft tubes extending respectively across the bottom of the primary combustion chamber from said generally vertical partition means to the generally vertical wall opposite that one wall forming with said partition means, the hot air flow passage, said air draft tubes forming a primary grate, primary and secondary air manifold headers open to the enclosure exterior and operatively coupled, respectively, to the ends of said first and second horizontal air draft tubes near said generally vertical partition means, said first tubes at their ends opposite the primary manifold headers and adjacent the opposite generally vertical wall bearing openings which open upwardly towards the top of said metal enclosure, and said second horizontal tubes at their ends opposite said secondary manifold header and adjacent the opposite generally vertical wall bearing openings which open downwardly towards the bottom of said metal enclosure, access means within said metal enclosure for supplying solid fuel to said primary combustion chamber and onto said primary grate;

whereby, primary air enters said primary manifold header and flows through said first horizontal air draft tubes to preheat said primary air and escapes through the openings within said first tubes and enters said primary combustion chamber at the lower portion thereof to effect primary combustion of the lower ends of the solid fuel and then passes across the length of said air draft tubes and downwardly between said first and second groups of horizontal tubes to seek the hot air passage to the stack, while secondary air enters said secondary air manifold header and flows horizontally through said second air draft tubes where it is preheated prior to discharge through the openings within the bottoms of said second tubes for mixing with the primary air along the full length of said air draft tubes for effecting combustion of gases given off by primary combustion of the solid fuel and combustion of solid fuel particles falling beneath said primary grate.

2. A solid fuel heater comprising:

a generally hollow vertical metal enclosure having top, bottom, and generally vertical front, rear and opposed sidewalls defining a vertical primary combustion chamber, a stack extending vertically upwardly from the top of said enclosure and opening to said combustion chamber, a generally vertical partition means extending partially along one generally vertical wall and spaced therefrom to define a generally vertical hot air flow passage to one side of said combustion chamber, a plurality of interposed coplanar first and second spaced horizontal air draft tubes extending respectively across the bottom of the primary combustion chamber from said vertical partition means to the generally vertical wall opposite that one wall forming with said partition means, the hot air flow passage, said air draft tubes forming a primary grate, primary and secondary air manifold headers open to the enclosure exterior and operatively coupled, respectively, to one end of said first and second horizontal tubes, said first tubes at their ends opposite the primary manifold header bearing openings which open upwardly towards the top of said metal enclosure, and said second horizontal tubes at their ends opposite said secondary manifold header bearing openings which open downwardly towards the bottom of said metal enclosure, access means within said metal enclosure for supplying solid fuel to said primary combustion chamber and onto said primary grate; and a secondary grate extending horizontally beneath said primary grate and spaced vertically therefrom for maintaining hot coals falling between said spaced primary grate tubes in an air path for both said primary and secondary air;

whereby, primary air enters said primary manifold header and flows through said first horizontal air draft tubes to preheat said primary air and escapes through the openings within said first tubes and enters said primary combustion chamber at the lower portion thereof to effect primary combustion of the lower ends of the solid fuel and then passes downwardly between said first and second groups of horizontal tubes and thence upwardly through the hot air flow passage to the stack, while secondary air enters said secondary air manifold header and flows horizontally through said second air draft tubes where it is preheated prior to discharge through the openings within the bottoms of said second tubes for mixing with the primary air and for effecting combustion of gases given off by primary combustion of the solid fuel and combustion of solid fuel particles falling beneath said primary grate.

3. The solid fuel heater as claimed in claim 2, further comprising a divider wall extending upwardly from said spaced horizontal tubes at the ends opposite said manifold headers and adjacent the openings within said first tubes for directing primary air upwardly from said tube holes adjacent said other generally vertical wall of said metal enclosure prior to entering said primary combustion chamber, and filler plates extending between said spaced horizontal tubes in the area of said openings within the top of said first tubes, so as to prevent primary air from passing downwardly between said tubes into the secondary combustion area between said primary grate tubes and said secondary grate.

4. The solid fuel heater as claimed in claim 3, further comprising an inclined shield extending from said other generally vertical wall of said enclosure and overlying said divider wall and being spaced vertically therefrom so as to prevent solid fuel from entering the space between said divider wall and said other generally vertical wall of said enclosure and blocking the holes within the tops of said first tubes, thereby assuring the passage of primary air to the primary combustion area above said primary grate tubes.

5. The solid fuel heater as claimed in claim 4, further comprising a false top wall underlying said top wall and extending transversely from said generally vertical partition to said other generally vertical wall, a hole within said false top wall generally aligned with said stack, and an updraft damper plate slidably mounted on said false top wall so as to selectively overlie said hole so as to vary the down flow characteristics of said heater and permit updraft flow through said false top plate hole directly to said stack, bypassing said hot air flow passage.

6. The solid fuel heater as claimed in claim 2, further comprising a false top wall underlying said top wall and extending transversely from said generally vertical partition to said other generally vertical wall, a hole within said false top wall generally aligned with said stack, and an updraft damper plate slidably mounted on said false top wall so as to selectively overlie said hole so as to vary the down flow characteristics of said heater and permit updraft flow through said false top plate hole directly to said stack, bypassing said hot air flow passage.

7. The solid fuel heater as claimed in claim 2, wherein said primary and secondary air manifold headers comprise joined elongated chambers sealed from said combustion chamber and extending across said heater from one side to the other, and wherein said first tubes open directly into and are fixed at one end to one vertical wall of said manifold header and said second tubes extend through said one header wall and are fixed at one end to a common vertical wall joining said first and second manifold headers and opening to said second header, and wherein the ends of said headers open outwardly of said enclosure and define primary and secondary air intake openings exterior of said enclosure, and said manifold headers further comprise separable adjustable primary and secondary draft gates adjustably closing off said primary and secondary air intake openings to respective primary and secondary manifold housings.

8. The solid fuel heater as claimed in claim 7, further comprising a primary and secondary intake box open at its top and a cover hinged to said one generally vertical wall of said enclosure and pivotably overlying the open top of said primary and secondary intake box, and wherein said solid fuel heater further comprises a thermostat mounted to the heater exterior so as to sense the temperature of a portion of said solid fuel heater and being operatively coupled to said hinged cover such that the rate of flow of primary and secondary air is varied in accordance with the temperature of said portion of the solid fuel heater so as to maintain uniform the temperature within the environment housing said solid fuel heater.

* * * * *